US007275505B2

(12) United States Patent
Moeller et al.

(10) Patent No.: US 7,275,505 B2
(45) Date of Patent: Oct. 2, 2007

(54) THERMAL REGULATION CONTROL FOR COMBUSTION NAILER

(75) Inventors: Larry M. Moeller, Schaumburg, IL (US); Mariam Vahabi-Nejad, Chicago, IL (US); Jeffry C. Ford, Zion, IL (US); Clayton O. Henry, Waukegan, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/329,438

(22) Filed: Jan. 11, 2006

(65) Prior Publication Data

US 2006/0260568 A1 Nov. 23, 2006

Related U.S. Application Data

(60) Provisional application No. 60/684,001, filed on May 23, 2005.

(51) Int. Cl.
*F02B 71/00* (2006.01)
*F02B 77/08* (2006.01)

(52) U.S. Cl. ..... 123/46 SC; 123/198 DB

(58) Field of Classification Search ..... 123/46 R, 123/46 SC, 198 D, 198 DB, 198 DC
See application file for complete search history.

(56) References Cited

U.S. PATENT DOCUMENTS

| | | | | |
|---|---|---|---|---|
| 6,123,241 | A | 9/2000 | Walter et al. | |
| 6,796,476 | B2 | 9/2004 | Birk et al. | |
| 6,886,730 | B2 | 5/2005 | Fujisawa et al. | |
| 7,021,251 | B2 * | 4/2006 | Ohmori et al. | 123/46 R |
| 2004/0182336 | A1 | 9/2004 | Ohmori et al. | |
| 2005/0173485 | A1 | 8/2005 | Moeller et al. | |
| 2005/0224024 | A1 | 10/2005 | Granacher et al. | |

FOREIGN PATENT DOCUMENTS

| | | |
|---|---|---|
| EP | 0 818 280 A2 | 1/1998 |
| WO | 2004/0873725 | 9/2004 |

* cited by examiner

*Primary Examiner*—Noah P. Kamen
(74) *Attorney, Agent, or Firm*—Greer, Burns & Crain, Ltd.; Lisa M. Soltis; Mark W. Croll

(57) ABSTRACT

A combustion nailer includes a combustion-powered power source, at least one fan associated with the power source, at least one temperature sensor in operational proximity to the power source for sensing power source temperature, and a control system operationally associated with the power source and the at least one temperature sensor for disabling the power source by disabling at least one main tool function upon the sensing of a predetermined temperature threshold sensed by the at least one temperature sensor.

11 Claims, 6 Drawing Sheets

THERMAL REGULATION CONTROL FOR COMBUSTION NAILER

RELATED APPLICATION

The present application claims priority under 35 USC § 120 from U.S. Ser. No. 60/684,001 filed May 23, 2005.

BACKGROUND

The present invention relates generally to fastener-driving tools used for driving fasteners into workpieces, and specifically to combustion-powered fastener-driving tools, also referred to as combustion tools or combustion nailers.

Combustion nailers are known in the art for use in driving fasteners into workpieces, and examples are described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 5,713,313, all of which are incorporated by reference herein. Similar combustion-powered nail and staple driving tools are available commercially from ITW-Paslode of Vernon Hills, Ill. under the IMPULSE® and PASLODE® brands.

Such tools incorporate a tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: mixing the fuel and air within the chamber; turbulence to enhance the combustion process; scavenging combustion by-products with fresh air; and cooling the engine. The engine includes a reciprocating piston with an elongated, rigid driver blade disposed within a single cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original or pre-firing position, through differential gas pressures created by cooling of residual combustion gases within the cylinder. Fasteners are fed magazine-style into the nosepiece, where they are held in a properly positioned orientation for receiving the impact of the driver blade.

The above-identified combustion tools incorporate a fan in the combustion chamber. This fan performs many functions, one of which is cooling. The fan performs cooling by drawing air though the tool between firing cycles. This fan is driven by power supplied by an onboard battery and, to prolong battery life, it is common practice to minimize the run time of the motor. Also, short fan run time reduces fan motor wear (bearings and brushes), limits sound emitting from the tool due to air flow, and most importantly limits dirt infiltration into the tool. To manage fan 'on time', combustion tools typically incorporate a control program that limits fan 'on time' to 10 seconds or less.

Combustion tool applications that demand high cycle rates, or prolonged use, or require the tool to operate in elevated ambient temperatures often cause tool component temperatures to rise. This leads to a number of performance issues. The most common is an overheated condition that is evidenced by the tool firing but no fastener driven. This is often referred to as a "skip" or "blank fire." As previously discussed, the vacuum return function of a piston is dependent on the rate of cooling of the residual combustion gases. As component temperatures rise, the differential temperature between the combustion gas and the engine walls is reduced. This increases the duration for the piston return cycle to such an extent that the user can open the combustion chamber before the piston has returned, even with a lockout mechanism installed. The result is the driver blade remains in the nosepiece of the tool and prevents advancement of the fasteners. Consequently, a subsequent firing event of the tool does not drive a fastener.

Another disadvantage of high tool operating temperature is that there are heat-related stresses on tool components. Among other things, the internal lubricating oil has been found to have reduced lubricating capacity with extended high temperature tool operation. Accordingly, elevated operational temperatures often require more frequent tool maintenance, necessitating unwanted tool downtime.

For general operating conditions of combustion nailers, the default fixed interval fan run time is adequate. For cases where more frequent use of the nailer warrants improved temperature control, the option of extended fan run time based on engine temperature has proven effective. However, there is a need for additional tool controls for situations where extended use of the tool generates temperature levels beyond the cooling effect of the extended fan run time. Such extended use of the nailer will eventually cause malfunction or breakdown.

Thus, there is a need for a combustion-powered fastener-driving tool which addresses the effects of elevated temperatures generated during high frequency or prolonged use, which is aggravated by high ambient temperatures. In addition, there is a need for a combustion-powered fastener-driving tool that manages tool operating temperatures within accepted limits to prolong performance, maintain relatively fast piston return to the pre-firing position, and extend component life.

BRIEF SUMMARY OF THE INVENTION

The above-listed needs are met or exceeded by the present thermal regulation control for a combustion nailer which features a method for preventing further operations of the nailer during a cool down cycle. This can be referred to as "advanced cooling mode". In the present advanced cooling mode, a control circuit prevents the operation of the nailer during a cool down period, which period can be either a set duration or can extend until a designated lower temperature threshold is reached. If the control circuit determines that the nailer should enter into "advanced cooling mode", the normal operating functions of the nailer are interrupted. This is performed by the control circuit failing to generate required optic switch driver signals, rendering the switches ineffective or disabling an electronic fuel injection apparatus. Without any switch inputs, no drive events can be initiated. Thus, no electronic fuel injection, change of operating modes or driver signals to other electronic controls will be generated during this period.

While the nailer is temporarily disabled, its overall useful operating time is extended. It has been shown that a 3-4 minute cool down period during tool disablement allows the nailer to resume normal operation for an extended period based on frequency of use. Without this function, the operation of an overheated nailer can be intermittent for more than 15 minutes.

More specifically, a combustion nailer includes a combustion-powered power source, at least one fan associated with the power source, at least one temperature sensor in operational proximity to the power source for sensing power source temperature, and a control system operationally associated with the power source, and the at least one temperature sensor for disabling the power source by disabling at least one main tool function upon the sensing of a predetermined temperature threshold sensed by the at least one temperature sensor.

In another embodiment, a combustion nailer includes a combustion-powered power source, at least one fan associated with the power source, at least one temperature sensor in operational proximity to the power source for sensing power source temperature, and a control system operationally associated with the power source and the at least one temperature sensor for disabling at least one of optic switch modulation and fuel injection function upon the sensing of a predetermined temperature threshold sensed by the at least one temperature sensor. Upon the control system disabling the at least one tool function, the control system is configured for energizing the fan while the control system monitors the temperature sensor and a preset timer is run, the fan energization having a duration of the lesser of the at least one temperature sensor reading the preset temperature and the expiration of a preset time on the timer.

DETAILED DESCRIPTION OF THE INVENTION

Figure 1:
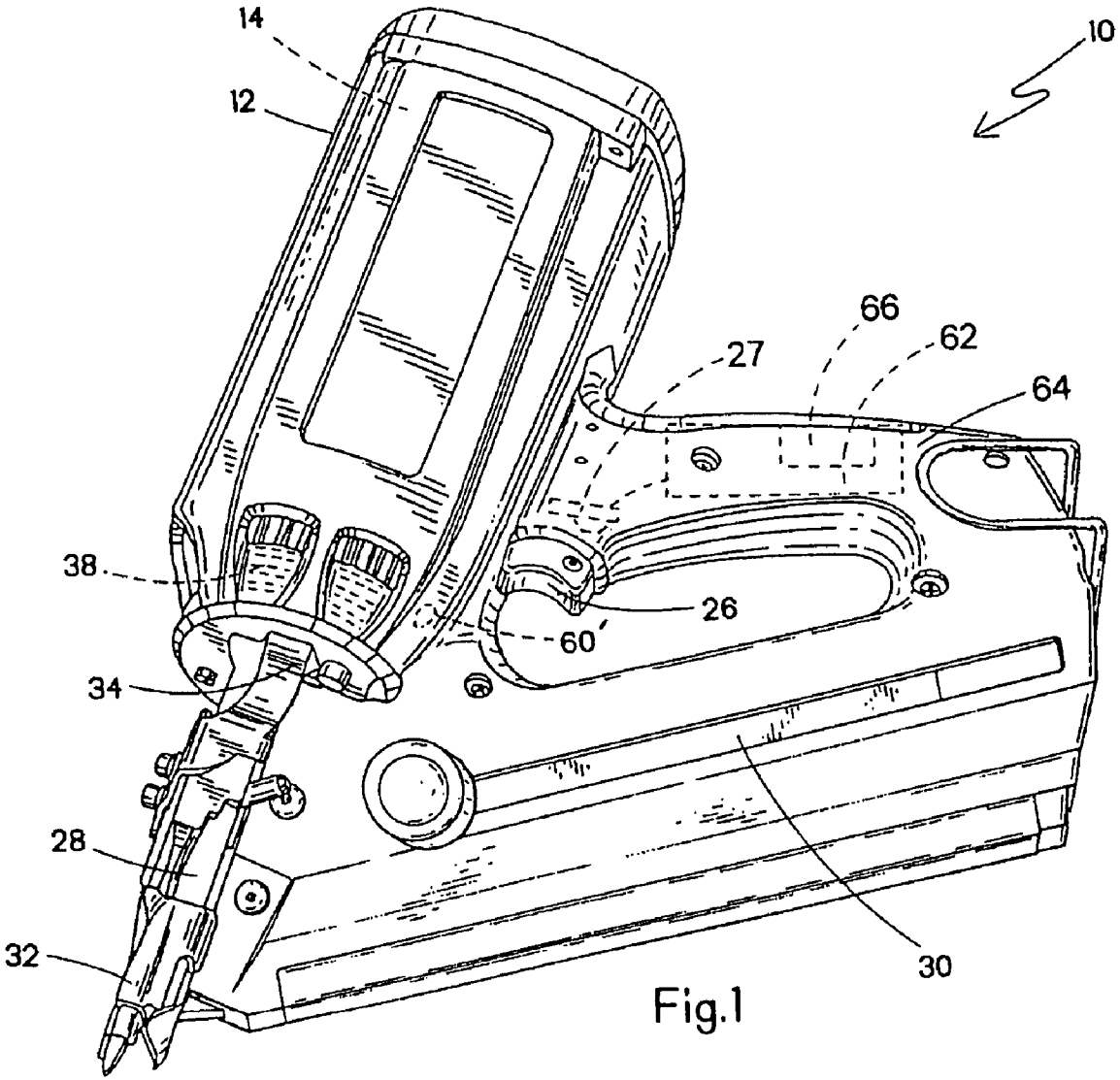
FIG. 1 is a front perspective view of a fastener-driving tool incorporating the present temperature control system.
Figure 2:
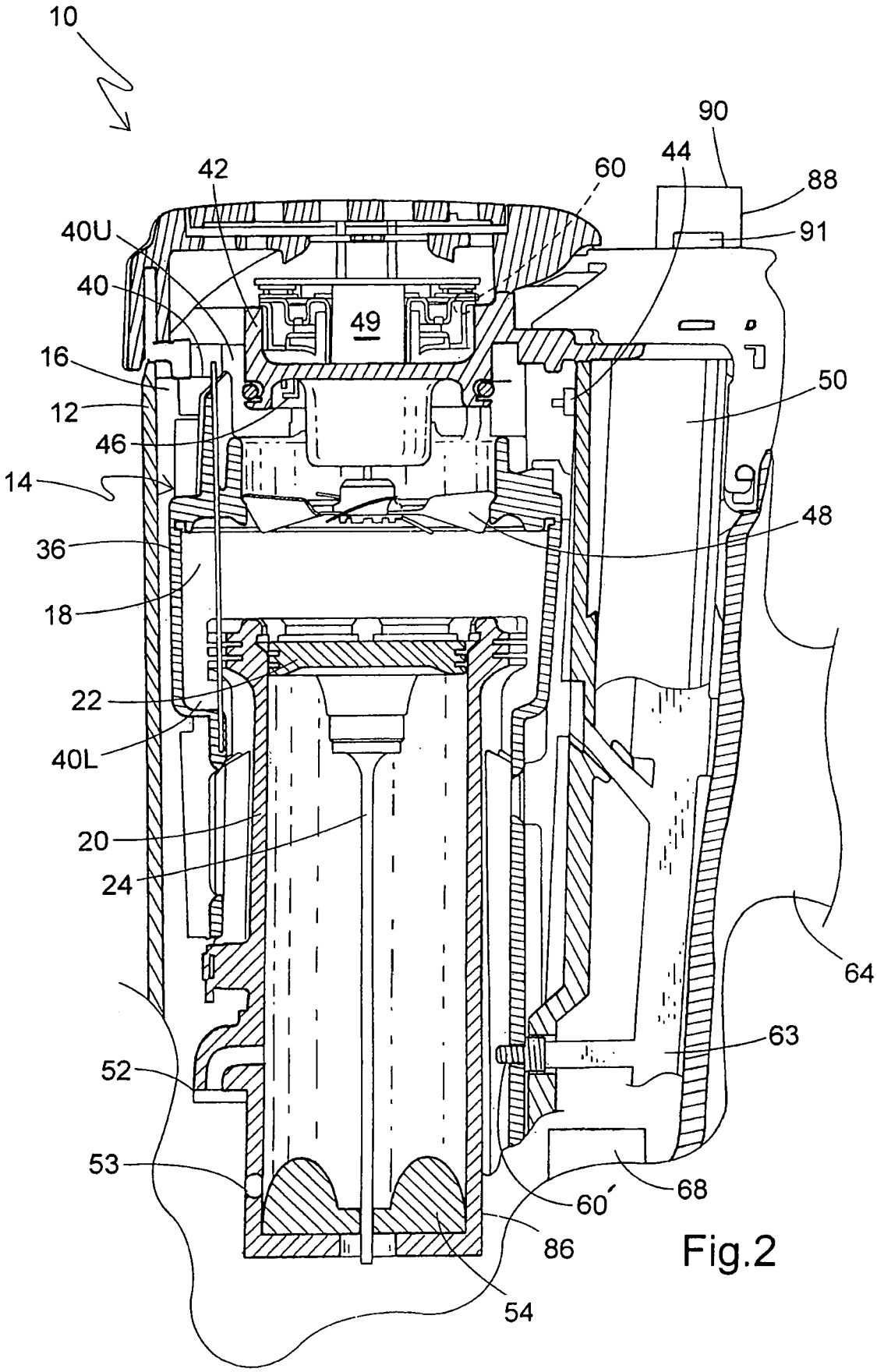
FIG. 2 is a fragmentary vertical cross-section of the tool of FIG. 1 shown in the rest position.

Referring now to FIGS. 1 and 2, a combustion-powered fastener-driving tool, also known as a combustion nailer, incorporating the present control system is generally designated 10 and preferably is of the general type described in detail in the patents listed above and incorporated by reference in the present application. A housing 12 of the tool 10 encloses a self-contained internal power source 14 (FIG. 2) within a housing main chamber 16. As in conventional combustion tools, the power source or combustion engine 14 is powered by internal combustion and includes a combustion chamber 18 that communicates with a cylinder 20. A piston 22 reciprocally disposed within the cylinder 20 is connected to the upper end of a driver blade 24. As shown in FIG. 2, an upper limit of the reciprocal travel of the piston 22 is referred to as a top dead center or pre-firing position, which occurs just prior to firing, or the ignition of the combustion gases which initiates the downward driving of the driver blade 24 to impact a fastener (not shown) to drive it into a workpiece.

Through depression of a trigger 26 associated with a trigger switch 27 (shown schematically and hidden), an operator induces combustion within the combustion chamber 18, causing the driver blade 24 to be forcefully driven downward through a nosepiece 28 (FIG. 1). The nosepiece 28 guides the driver blade 24 to strike a fastener that had been delivered into the nosepiece via a fastener magazine 30.

Included in the nosepiece 28 is a workpiece contact element 32, which is connected, through a linkage 34 to a reciprocating valve sleeve 36, an upper end of which partially defines the combustion chamber 18. Depression of the tool housing 12 against the workpiece contact element 32 in a downward direction as seen in FIG. 1 (other operational orientations are contemplated as are known in the art), causes the workpiece contact element to move from a rest position to a pre-firing position. This movement overcomes the normally downward biased orientation of the workpiece contact element 32 caused by a spring 38 (shown hidden in FIG. 1). Other locations for the spring 38 are contemplated.

Through the linkage 34, the workpiece contact element 32 is connected to and reciprocally moves with, the valve sleeve 36. In the rest position (FIG. 2), the combustion chamber 18 is not sealed, since there is an annular gap 40 including an upper gap 40U separating the valve sleeve 36 and a cylinder head 42, which accommodates a spark plug 46, and a lower gap 40L separating the valve sleeve 36 and the cylinder 20. A chamber switch 44 is located in proximity to the valve sleeve 36 to monitor its positioning. In the preferred embodiment of the present tool 10, the cylinder head 42 also is the mounting point for at least one cooling fan 48 and the associated fan motor 49 which extends into the combustion chamber 18 as is known in the art and described in the patents which have been incorporated by reference above. In addition, U.S, Pat. No. 5,713,313 also incorporated by reference, discloses the use of multiple cooling fans in a combustion-powered tool. In the rest position depicted in FIG. 2, the tool 10 is disabled from firing because the combustion chamber 18 is not sealed at the top at the cylinder head 42, and the chamber switch 44 is open.

Also, as is known in the art, the spark plug 46 is activated based on operating conditions of the chamber switch 44 and the trigger switch 27, which are both optic switches, a suitable type being disclosed in U.S. Pat. No. 5,191,209 which is incorporated by reference.

Firing, combustion or activation (the terms are used interchangeably) is enabled when an operator presses the workpiece contact element 32 against a workpiece. This action overcomes the biasing force of the spring 38, causes the valve sleeve 36 to move upward relative to the housing 12, closing the gap 40, sealing the combustion chamber 18 and activating the chamber switch 44. This operation also induces a measured amount of fuel to be released into the combustion chamber 18 from a fuel canister 50 (shown in fragment).

In a mode of operation known as sequential operation, upon a pulling of the trigger 26, the spark plug 46 is energized, igniting the fuel and air mixture in the combustion chamber 18 and sending the piston 22 and the driver blade 24 downward toward the waiting fastener for entry into the workpiece. An alternate mode of operation is referred to as repetitive firing, in which ignition is achieved by the closing of the chamber switch 44, since the trigger 26 is already pulled and the associated trigger switch 27 is closed. As the piston 22 travels down the cylinder 20, it pushes a rush of air which is exhausted through at least one petal, reed or check valve 52 and at least one vent hole 53 located beyond the piston displacement (FIG. 2). At the bottom of the piston stroke or the maximum piston travel distance, the piston 22 impacts a resilient bumper 54 as is known in the art. With the piston 22 beyond the exhaust check valve 52, high pressure gasses vent from the cylinder 20. Due to cooling of the residual gases, internal pressure differentials in the cylinder 20, cause the piston 22 to be forced back to the pre-firing position shown in FIG. 2.

To manage those cases where extended tool cycling and/or elevated ambient temperatures induce elevated power source temperature, at least one temperature sensor 60, 60' such as a thermistor (shown hidden in FIGS. 1 and 2) is preferably located in close operational relationship to the combustion engine 14, such as at an upper end of the cylinder head 42 (60) or at a lower end of the cylinder 20 (60') and is preferably disposed to be in or in operational relationship to, a forced convection flow stream of the tool 10. Other types of temperature sensors 60, 60' are contemplated besides the thermistor. Also, other locations on the tool 10 are contemplated depending on the application, provided they monitor combustion engine temperature. The temperature sensor 60, 60' is connected to a control unit 62 (shown hidden in FIG. 1) which includes a microprocessor, a molded circuit board 63 and is located in a handle portion 64 of the housing 12. Included in the control unit 62 is a control program 66 (not shown) and described in commonly assigned, copending U.S. patent application Ser. No. 11/028,020 filed Jan. 3, 2005, which is incorporated by reference. The program 66 is configured to extend 'on time' of the at least one cooling fan 48 until the temperature is lowered to the preferred "normal" operating range. Alternately, the program 66 is configured to hold the fan 48 on for a fixed time, for example 90 seconds, which is long enough to assure that the temperature of the power source or combustion engine 14 has returned to the "normal" operating range. As is known in the art, the program 66 also incorporates the management functions identified in circuit format in U.S. Pat. No. 5,133,329, which is incorporated by reference. Also, it is contemplated that the microprocessor-based program 66 may be replaced in the control unit 62 by a circuit using discrete components.

A target threshold temperature where elevated temperature levels increase tool malfunctions is selected based upon the proximity of the temperature sensor 60, 60' to the components of the power source 14, the internal forced convection flow stream, and desired cooling effects to avoid nuisance fan operation. Excessive fan run time unnecessarily draws contaminants into the tool 10 and depletes battery power. Other drawbacks of excessive fan run time include premature failure of fan components and fan-induced operational noise of the tool 10. For demanding high cycle rate applications and/or when elevated ambient temperatures present temperature-related tool malfunction issues, temperature controlled forced convection will yield more reliable combustion-powered nail performance and will also reduce thermal stress on the tool.

Figure 3A:
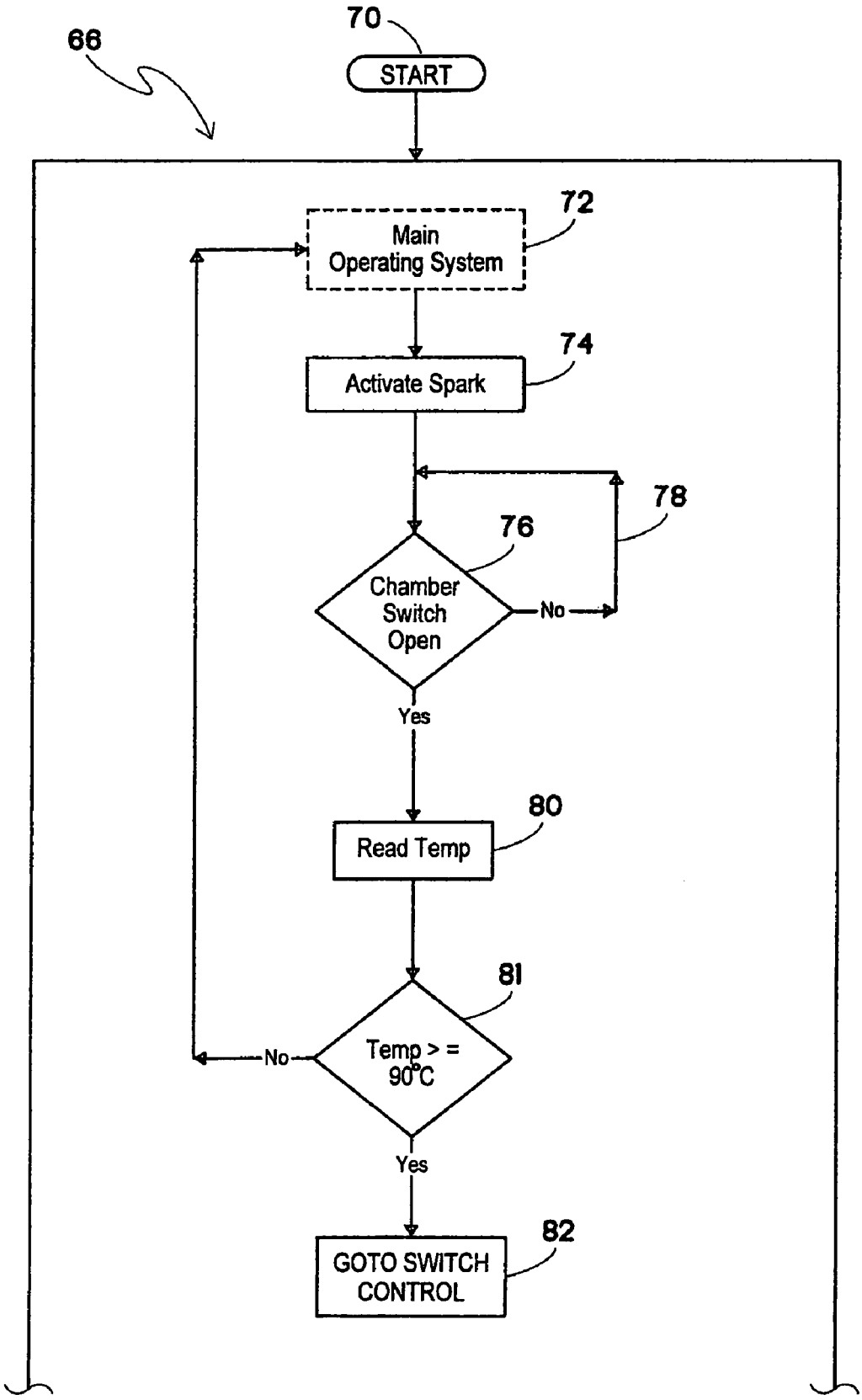
FIGS. 3A-3B are a schematic flow chart of the present control system configured for shutting down tool optic switches.

Referring now to FIG. 3A, a preferred embodiment of the control program 66 is depicted in which the program disables tool functionality by preventing main tool functions as a result of disabling at least one of the tool's optic switches, such as the chamber switch 44 or the trigger switch 27. Controlling the optic switches has been found to be an effective method of preventing tool operation for a period of forced cooling. In the present application, "disabling" refers to the disconnection or cessation of any energizing signals to the components originating from the control unit 62. The result of the disabling function of the program 66 is that the operational signals are not received by the control program to initiate or perform other tool functions, such as fuel injection. Any operation of an electric fuel metering valve 68 (shown partially in FIG. 2) during such cooling periods would unnecessarily waste fuel.

Beginning at the START prompt 70, upon turning on the tool 10, the program 66 performs normal tool operation such as turning on the fan 48 upon the workpiece contact element 32 being pressed against the workpiece, the supply of fuel to the combustion chamber 18, the energization of the spark plug 46 and associated warning indicators and alarms. These functions are represented generally by Main Operating System 72. Upon the program 66 activating a spark at the spark plug 46 at 74, the program checks to see if the chamber switch 44 is open at 76. If the switch 44 is closed, the tool 10 will fire. The program 66 cycles at 78 here until the switch 44 is open.

At that point, the program 66 obtains a temperature reading at 80 from the temperature sensor 60, 60'. The program 66 has a preset acceptable tool upper range operating temperature, which in the preferred embodiment is 90° C., however other values are contemplated depending on the tool, area of use, or other known factors. The selected temperature is determined on the basis of a threshold at which temperature-related operational problems begin to occur in the tool 10. If, at step 81, the sensor 60, 60' indicates that the temperature is less than the threshold temperature, the program 66 returns to main operating system functions at 72, indicating that acceptable tool operating temperatures exist.

Figure 3B:
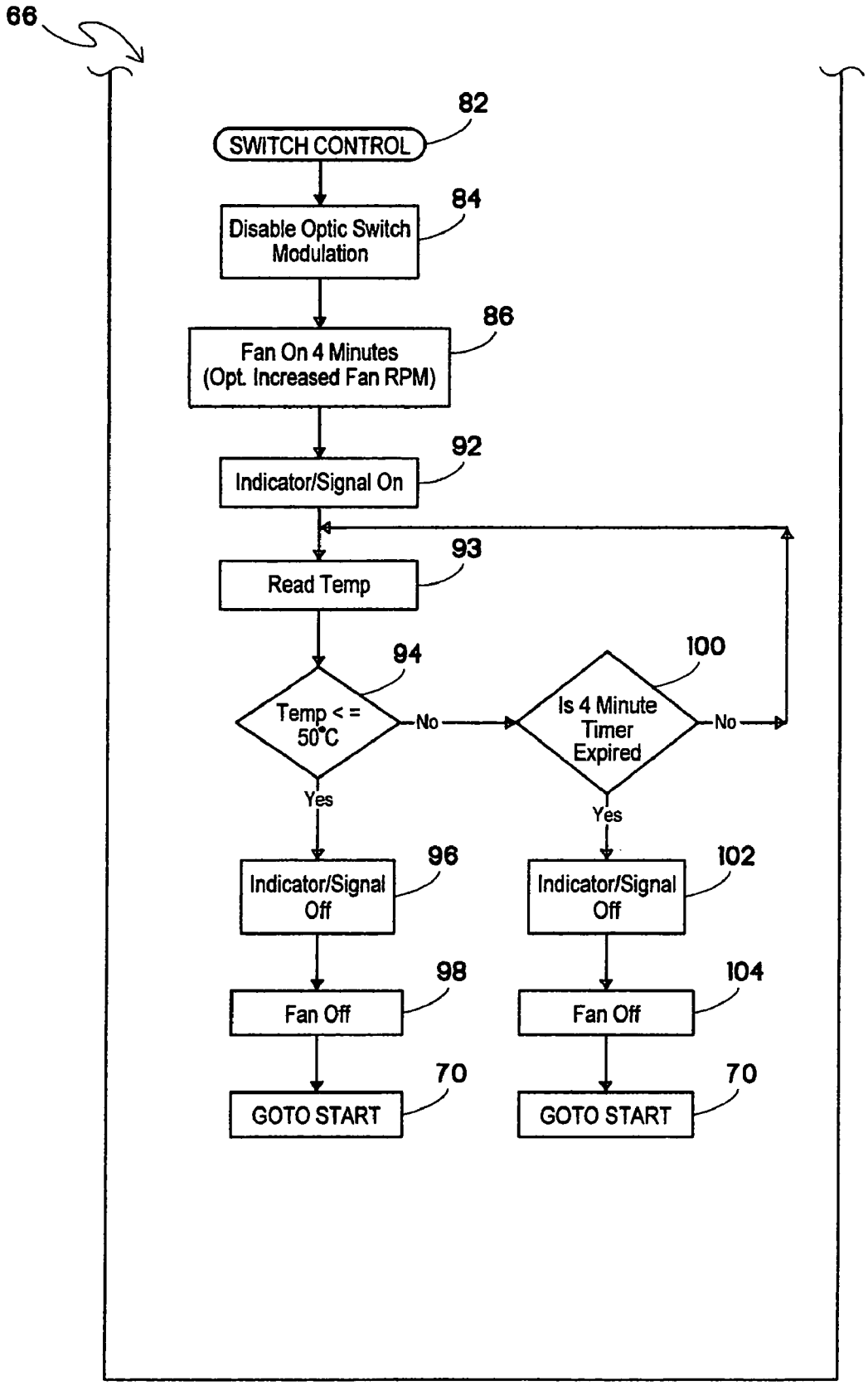

However, if the sensed temperature is equal to or exceeds the threshold temperature of 90° C., the tool 10 risks temperature-induced malfunctions and the program 66 changes to a SWITCH CONTROL mode at 82. Referring now to FIG. 3B, in SWITCH CONTROL mode, at step 84 the program 66 disables optic switch modulation within the control unit 62, which renders chamber switch 44 and the trigger switch 27 ineffective, thereby the tool 10 cannot accept inputs from the operator. As a result, certain tool features and functions will not operate. This includes the fuel injection pump 68 and control mechanisms for operating in sequential or repetitive firing modes.

Upon disabling of the optic switches, the program 66 then energizes the fan 48 at step 86 for a preset time, preferably four minutes, however other periods are contemplated depending on the circumstances. As described above, periods of 2-3 minutes have provided satisfactory cooling in some instances. The four minute period has been found to be acceptable for tool cooling in the absence of additional combustion cycles. The cooling occurs through fan induced cooling convection.

To indicate the status of the tool 10 to the operator, an indicator 88 (FIG. 2), which can be visual or audible, is located on the housing 12. To improve the effectiveness of the thermal regulation control feature or mode represented by step 86, the fan RPM generated by the motor 49 is increased beyond a preset or predetermined operational speed to provide more airflow through the tool 10.

In one embodiment, the indicator is a lens 90 enclosing an LED 91 (FIG. 2), which is connected to the tool's molded circuit board 63 just above the chamber switch 44. The lens 90 is located on a rounded edge of the handle near the cap directly above the LED. This easy-to-view location alerts the operator of the cooling period.

The indicator 88 is energized at step 92. Next, the program 66 checks whether one of two conditions is met:

either the temperature is equal to or falls below a reduced or lower threshold, 50° C., or a 4 minute timer determining fan run time has expired. More specifically, at step 93 the temperature is read from sensor 60, 60' and at step 94 the program 66 determines whether the power source temperature is below the lower threshold. If it has, the tool 10 is cool enough to resume operation and, at step 96, the indicator 88 is turned off, and at 98 the fan 48 is turned off. The program 66 then reverts to the normal operating procedure, going to START at 70. The tool 10 is thus revived from its disabled condition.

If the sensed temperature is not below the threshold, the program 66 checks at 100 whether the fan run timer has expired. If not, the program 66 cycles until either the temperature is reduced sufficiently or the timer has expired. Once the fan run timer expires, the indicator 88 is turned off at 102, the fan is turned off at 104 and the program reverts to START at 70.

Figure 4A:
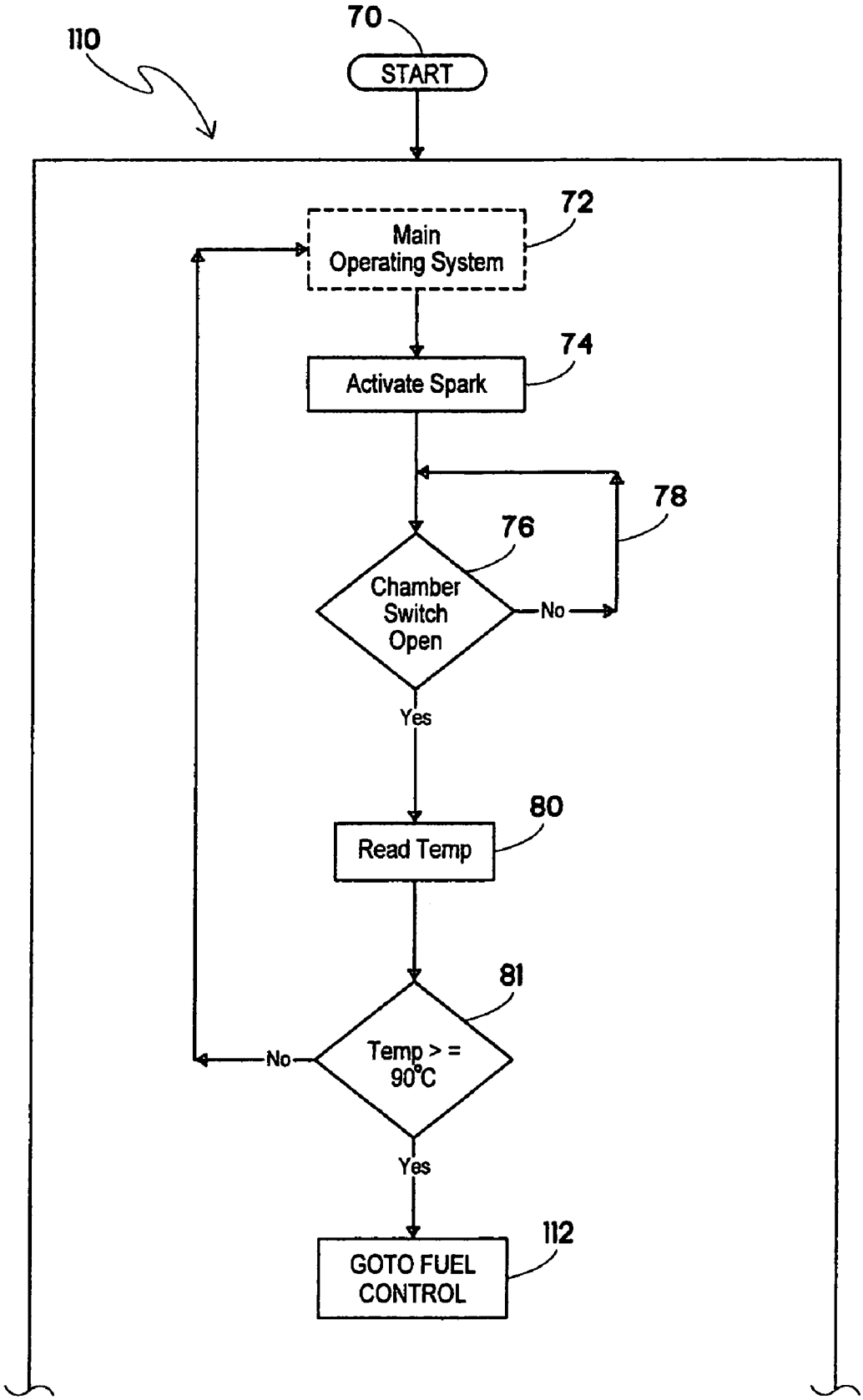
FIGS. 4A-4B are a schematic flow chart of an alternate embodiment of the present control system configured for shutting down fuel delivery.

Referring now to FIG. 4A, as an alternative embodiment to the program 66, which is focused on disabling the optic switches, it is also contemplated that the tool 10 can be disabled by turning off the supply of fuel. The fuel is typically supplied either by mechanical fuel metering valves known in the art, or electronic fuel injection systems. An exemplary fuel injection system for a combustion nailer is U.S. Pat. No. 6,102,270, incorporated by reference and is represented here by a fuel metering valve 68 which is operated by the control unit 62. The alternative program, generally designated 110, incorporates many of the same steps as the program 66, which are designated with identical reference numbers. However the program 110 differs by disabling electronic fuel injection rather than the optic switches.

More specifically, the first portion of the program 110 is identical to the program 66 as far as steps 70 to 81. However, if the sensed temperature is equal to or exceeds the threshold temperature of 90° C. at step 81, the tool 10 is subject to temperature-induced malfunctions and the program 110 changes to a FUEL CONTROL mode at 112.

Figure 4B:
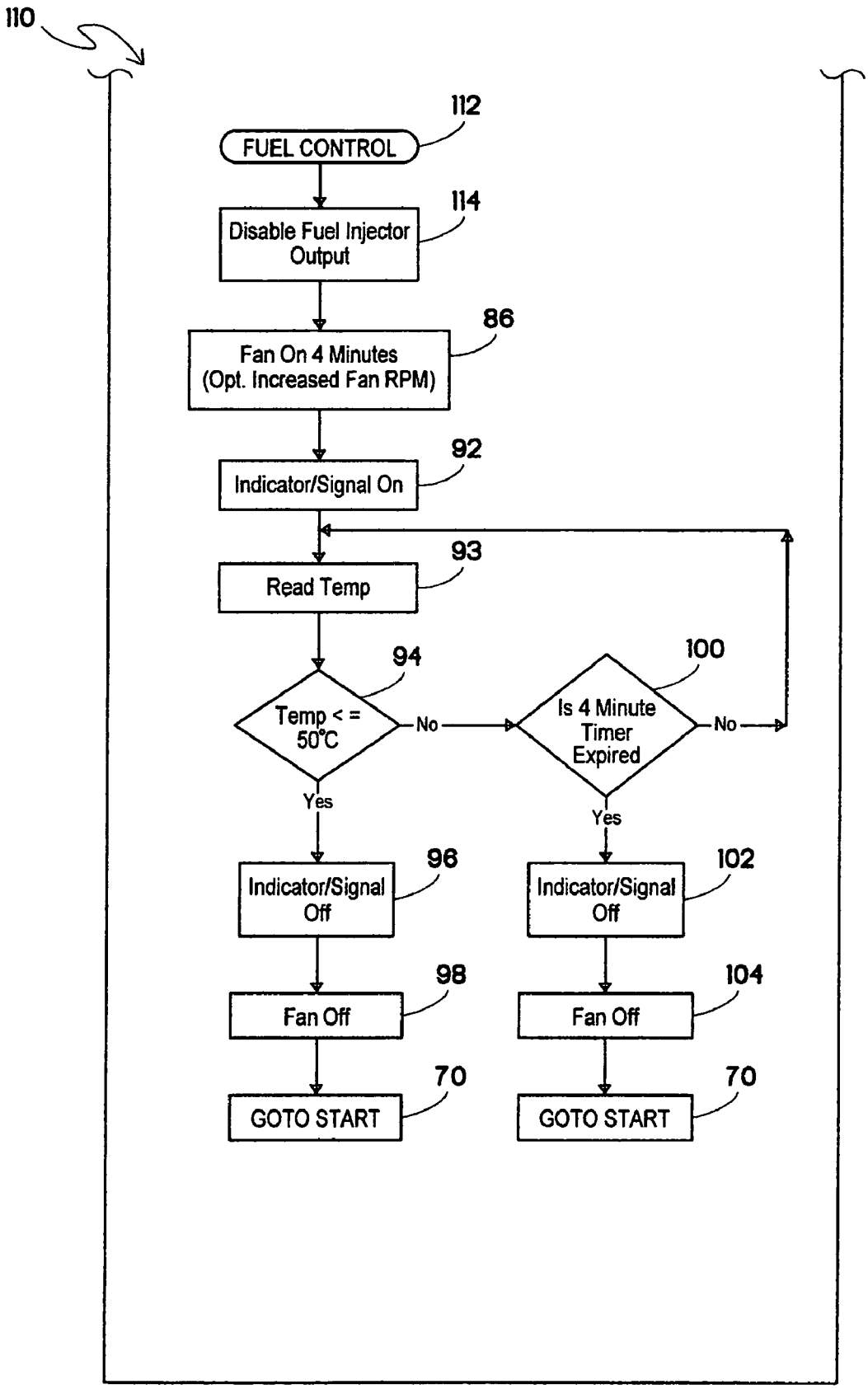

Referring now to FIG. 4B, in FUEL CONTROL mode, at step 114 the program 110 disables fuel injector output at the control unit 62, which controls the operation of the fuel metering valve 68. Without fuel being injected into the combustion chamber 18, the tool 10 cannot operate, since even if the spark plug 46 is energized, the absence of fuel will prevent combustion. Since this condition is created due to abnormally high power source temperatures, as in FIG. 3B, at step 86 the program 110 then energizes the fan 48 for a preset time, preferably four minutes, however other periods are contemplated depending on the circumstances. As is the case with the program 66, the indicator 88 is activated at step 93 to indicate tool condition to the operator.

The remaining operational steps of the program 110 are identical to the program 66, as reflected in the schematic of FIG. 4B. More specifically, at step 93 the temperature is read from sensor 60, 60' and at step 94 the program 110 determines whether the power source temperature is less than or equal to the lower or reduced threshold. If it is, the tool 10 is cool enough to resume operation and, at step 96, the indicator 88 is turned off, and at 98 the fan 48 is turned off. The program 110 then reverts to the normal operating procedure, going to START at 70.

If the sensed temperature is not below the threshold, the program 110 checks at 100 whether the fan run timer has expired. If not, the program 110 cycles until either the temperature is reduced sufficiently or the timer has expired. Once the fan run timer expires, the indicator 88 is turned off at 102, the fan is turned off at 104 and the program reverts to START at 70.

While particular embodiments of the present thermal regulation control for a combustion nailer has been described herein, it will be appreciated by those skilled in the art that changes and modifications may be made thereto without departing from the invention in its broader aspects and as set forth in the following claims.

The invention claimed is:

1. A combustion nailer, comprising:

a combustion-powered power source;

at least one fan associated with said power source;

at least one temperature sensor in operational proximity to said power source for sensing power source temperature; and a control system operationally associated with said power source and said at least one temperature sensor for disabling said power source by disabling at least one main tool function upon the sensing of a predetermined temperature threshold sensed by said at least one temperature sensor;

wherein said at least one disabled main tool function is at least one of fuel injection metering operation and optic switch modulation, and said at least one function is disabled directly from said control system.

2. The tool of claim 1 wherein said control system is connected to said at least one fan and, upon disabling of said at least one main tool function, said fan is energized for a predetermined amount of time.

3. The tool of claim 2 wherein said fan is energized at a speed which is greater than a preset normal operating speed.

4. The tool of claim 1 wherein said control system is connected to said at least one fan and, upon disabling of said at least one main tool function, said fan is energized until a reduced temperature threshold is reached.

5. The tool of claim 1 wherein upon said control system disabling said at least one main tool function, said fan is energized while said control system monitors said at least one temperature sensor and a preset timer is run, said fan energization having a duration of the lesser of said temperature sensor reading a reduced preset temperature and the expiration of a preset time on said timer.

6. The tool of claim 1 further including at least one indicator for indicating to a user that said tool is disabled for cooling purposes.

7. The tool of claim 6 wherein said tool is configured so that upon the sensed power source temperature being within acceptable limits, said indicator is deenergized.

8. A combustion nailer, comprising:

a combustion-powered power source;

at least one fan associated with said power source;

at least one temperature sensor in operational proximity to said power source for sensing power source temperature; and a control system operationally associated with said power source and said at least one temperature sensor for disabling at least one main tool function upon the sensing of a predetermined temperature threshold sensed by said at least one temperature sensor; and wherein upon said control system disabling said at least one main tool function, said control system is configured for energizing said fan while said control system monitors said temperature sensor and a preset timer is run, said fan energization having a duration of the lesser of said at least one temperature sensor reading a preset reduced temperature and the expiration of a preset time on said timer.

9. The tool of claim 8 wherein said at least one disabled main tool function includes at least one of fuel metering operation and optic switch modulation.

10. A combustion nailer, comprising:

a combustion-powered power source;

at least one fan associated with said power source;

at least one temperature sensor in operational proximity to said power source for sensing power source temperature; and a control system operationally associated with said power source and said at least one temperature sensor for directly disabling at least one of optic switch modulation and fuel injection function upon the sensing of a predetermined temperature threshold sensed by said at least one temperature sensor;

wherein upon said control system disabling said at least one main tool function, said control system is configured for energizing said fan while said control system monitors said temperature sensor and a preset timer is run, said fan energization having a duration of the lesser of said at least one temperature sensor reading a preset reduced temperature and the expiration of a preset time on said timer.

11. The tool of claim 10, further including at least one indicator connected to said control system for indicating to a user that said tool is disabled for cooling purposes, wherein said tool is configured so that upon the sensed power source temperature being within acceptable limits, said indicator is deenergized.

* * * * *